US007800288B2

(12) United States Patent
Li

(10) Patent No.: US 7,800,288 B2
(45) Date of Patent: Sep. 21, 2010

(54) ASSEMBLED MAGNETIC ENERGY GENERATOR AS WELL AS ITS MAGNETIC LIGHT

(76) Inventor: Jin Li, No. 201, Unit 3, Building 11, DongHua Garden, ShiJi Town, PanYu District, Guangzhou, Guangdong (CN)

( * ) Notice: Subject to any disclaimer, the term of this patent is extended or adjusted under 35 U.S.C. 154(b) by 878 days.

(21) Appl. No.: 10/586,405

(22) PCT Filed: Dec. 20, 2005

(86) PCT No.: PCT/CN2005/002258

§ 371 (c)(1),
(2), (4) Date: Jul. 18, 2006

(87) PCT Pub. No.: WO2006/066503

PCT Pub. Date: Jun. 29, 2006

(65) Prior Publication Data

US 2008/0231995 A1 Sep. 25, 2008

(30) Foreign Application Priority Data

Dec. 22, 2004 (CN) ..... 2004 1 0077799

(51) Int. Cl.
*H01J 1/50* (2006.01)
*H01F 1/00* (2006.01)

(52) U.S. Cl. ..... 313/153; 315/248; 335/209

(58) Field of Classification Search ..... 313/153–162; 315/248, 267, 344; 335/209, 212, 219
See application file for complete search history.

(56) References Cited

U.S. PATENT DOCUMENTS 4,163,826 A * 8/1979 Kawaguchi et al. ..... 428/371
4,547,705 A * 10/1985 Hirayama et al. ..... 315/219
5,395,218 A * 3/1995 Thompson ..... 417/416
5,834,905 A * 11/1998 Godyak et al. ..... 315/248

* cited by examiner

*Primary Examiner*—Nimeshkumar D. Patel
*Assistant Examiner*—Anne M Hines
(74) *Attorney, Agent, or Firm*—Raymond Y. Chan; David and Raymond Patent Firm

(57) ABSTRACT

The present invention discloses a magnetic light, having a magnetic energy generator for supporting a light body penetrated through therein, the magnetic energy generator includes a pair of detachable members jointed together with a face to face manner, wherein each of the magnetic members has at least an indented groove define onto a facing side at an aligned position for supporting the light body, such that when such two magnetic members approach with each other, the correspondingly mated indented grooves will combine to clamp the light body therebetween and to from a magnetic air gap between two magnetic members for communicating seperated the indented grooves,accordingly, an insulated bakelite frame provided onto the magnetic air gap for winding up an electromagnetic wire.

12 Claims, 5 Drawing Sheets

ASSEMBLED MAGNETIC ENERGY GENERATOR AS WELL AS ITS MAGNETIC LIGHT

BACKGROUND OF THE PRESENT INVENTION

1. Field of Invention

The present invention relates to luminous means, and more particularly, relates to a kind of magnetic light utilizing an assembled magnetic generator for activating a luminous body to shine up the light.

2. Description of Related Arts

Magnetic lights utilize high-frequency magnetic energy resonance theory to replace conventional filament illumination theory, which employs LC series filaments having fluorescent electrode, wherein the electrode could be heated to activate fluorescent powder for illumination. By applying the magnetic lights, the luminous efficiency would be significantly improved as much as 20% and the fluorescent light-attenuating phenomena could be neglected. And more importantly, the life-span of the light could be extended 16 times, the energy-saving efficiency could be increased around 35-45%, and the input efficiency could achieve 6 W-1500 W. however, the electrodeless lamp and the electromagnetic light introduced into the market had been complained about the inefficient structure and expensive costs. The embodied electromagnetic light could not achieve the prospective efficiency claimed by the magnetic light. For example, the input power of the light could not exceed 165 W, and the luminous efficiency could not exceed 601 m/W. That is to say, the magnetic light is still lingered within the initiating phrase after 15 years efforts, and is still far from wide development and spread in the market.

The high frequency electromagnetic induction device has been widely considered as a bottleneck of an efficient electromagnetic lamp. Commonly, the electromagnetic induction device comprises a magnetic ring, which is embodied as a pair of detachable inductive magnetic elements, wherein such magnetic ring could not be securely positioned. The magnetic air-gap between the on-off positions of the magnetic ring is randomly determined and no accurate positioned could be ensured. As a result, the electromagnetic equivalent could not be managed in applications. On the other hand, the electromagnetic induction coil is winded onto respective magnetic ring, wherein the distance between two half circle of the electromagnetic ring is undetermined and the magnetic air-gap is randomly selected as well. As a result, the electromagnetic intensity of the closed circuit could not be measured. Furthermore, the separated magnetic body have been disposed with an unstable condition, wherein the distance, relative position, gap, space and air-gap between each other could not be secured, thus resulting the magnetic ring working in a constantly unstable status. What is more, the soft magnetic ferrite of the electromagnetic induction device could not be relatively secured at a fixed position, after the circuit is charged to enable the induction magnetic filed to shine up the light, the high temperature emitted from the lamp and the soft magnet ferrite would affect the magnetic material thus generating expanding of the materials, as a result, the magnetic filed intensity could be not controlled. The magnetic filed voltage could not controlled as well, the constantly soared magnetic current would result to the instability of the physical property of the magnetic materials provided onto the magnetic coil. Furthermore, the magnetic air-gap would be continuously enlarged thanks to the unstable magnetic field intensity and the high temperature of the lamp, thus forming an uncontrollable cycle, i.e. the current and voltage would be increased as well. Accordingly, such increased current and voltage would affect the resonance oscillating frequency of the magnetic ring, such variance of the oscillating frequency would output power of the lamp gradually increased.

SUMMARY OF THE PRESENT INVENTION

A primary object of the present invention is to provide a magnetic energy generator, having a pair of separated magnetic body for winding electromagnetic induction coils thereon, wherein two separated magnetic bodies are secured with other at stable space, position, gap, and distance so as to generate a fixed magnetic air gap therebetween, and more importantly, to form an ensured electromagnetic intensity of a completed magnetic circuit.

Accordingly, to achieve above object, the present invention provides a magnetic generator, comprising a pair of detachable magnetic bodies coupled with each other at a face to face manner to complete a magnetic circuit, wherein a fixed magnetic air gap is formed therebetween for accurately positioning a magnetic field center of the magnetic circuit, and for ensuring an electromagnetic induction current volume.

According to the present invention, the magnetic body further comprises a bakelite frame for enwinding electromagnetic induction coil. It is noted that the fixed magnetic air gap is capable of ensuring the electromagnetic induction current, therefore, the manageability and the reliability of the electromagnetic circuit could be enormously improved. Ultimately, the compatibility and quality of the product could be under control of the manufacturer so as to pave the way for industry-scale production.

It is noted that the magnetic body of the present invention has two separated magnetic members detachably coupled with each other at a face to face manner, wherein each of the magnetic member has at least two indented grooves defined on a facing side, such that when two magnetic member approach with each other, indented grooves respectively defined onto two magnetic members will correspondingly align to form at least two magnetic gaps interposed between two magnetic members. There are two engaging shoulder respectively defined at two side ends of the magnetic member for ensuring two magnetic members detachably coupled together to form the magnetic body. It is noted such engaging shoulders could ensure two engaging members attached at a stable manner. Finally, the insulated bakelites are correspondingly provided within the magnetic gaps for supporting the electromagnetic coils.

Or otherwise, the magnetic body of the present invention has two separated magnetic members detachably coupled with each other at a face to face manner, wherein each of the magnetic member has at least two indented grooves defined on a facing side, such that when two magnetic member approach with each other, indented grooves respectively defined onto two magnetic members will correspondingly align to form at least two magnetic gaps interposed between two magnetic members. There are two engaging shoulders respectively defined at two side ends of the magnetic member for ensuring two magnetic members detachably coupled with each other to form the magnetic body. It is noted such engaging shoulder could ensure two engaging members attached at a stable manner. Finally, the insulated bakelites are correspondingly provided within the magnetic gaps for supporting the electromagnetic coils. The magnetic member could be defined as rectangular body shape, half-circle shape and any other irregular shape.

Or otherwise, the magnetic body of the present invention has two separated magnetic members detachably coupled with each other at a face to face manner, wherein each of the magnetic member has at least two indented grooves defined on a facing side, such that when two magnetic member approach with each other, indented grooves respectively defined onto two magnetic members will correspondingly align to form at least two magnetic gaps interposed between two magnetic members. There are two engaging shoulders respectively defined at two side ends of the magnetic member for ensuring two magnetic members detachably coupled with each other to form the magnetic body. It is noted such engaging shoulder could ensure two engaging members attached at a stable manner. Finally, the insulated bakelites are correspondingly provided within the magnetic gaps for supporting the electromagnetic coils. The magnetic member could be defined as rectangular body shape, half-circle shape and any other irregular shape.

Or otherwise, the magnetic body of the present invention has two separated magnetic members detachably coupled with each other at a face to face manner, wherein each of the magnetic member has at least one indented groove defined on a facing side, such that when two magnetic member approach with each other, indented grooves respectively defined onto two magnetic members will correspondingly align to form at one magnetic gap interposed between two magnetic members. There are two engaging shoulders respectively defined at two side ends of the magnetic member for ensuring two magnetic members detachably coupled with each other to form the magnetic body. It is noted such engaging shoulder could ensure two engaging members attached at a stable manner. Finally, the insulated bakelites are correspondingly provided within the magnetic gaps for supporting the electromagnetic coils.

Or otherwise, the magnetic body of the present invention has two separated magnetic members detachably coupled with each other at a face to face manner, wherein each of the magnetic member has at least one central indent defined on a facing side, such that when two magnetic member approach with each other, two central indents defined onto two magnetic members will correspondingly align to form at one central gap defined between two magnetic members. There are two engaging shoulders respectively defined at two side ends of the magnetic member for ensuring two magnetic members detachably coupled with each other to form the magnetic body. It is noted such engaging shoulder could ensure two engaging members attached at a stable manner. Finally, the insulated bakelites are correspondingly provided within the central gap for supporting the electromagnetic coils. The magnetic member could be defined as rectangular body shape, half-circle shape and any other irregular shape.

According to the present invention, the light body of the magnetic light is mounted onto the magnetic energy generator, wherein the two magnetic members of the magnetic body are wrapping up the light body, the light body is penetrating through the magnetic generator to be positioned at one end of the magnetic body.

Accordingly, the magnetic light of the present invention comprises a light body and a magnetic energy generator, wherein the magnetic energy generator has a magnetic body having two separated magnetic members detachably coupled with each other at a face to face manner to for a closed magnetic air gap, wherein each of the magnetic member has at least two indented grooves defined on a facing side, such that when two magnetic member approach with each other, such indented grooves respectively defined onto two magnetic members will correspondingly align to form at least two magnetic gaps interposed between two magnetic members; the light body is received within the indented groove such that two indented grooves are capable wrapping up the light body. It is noted that the light body is penetrating through the magnetic generator.

It is noted that the insulated bakelite frame is disposed onto the light body of the magnetic light wherein the electromagnetic induction coil is winded onto the bakelite frame.

The magnetic body comprises two detachable magnetic members, each of which has a shoulder portion at two side ends for interlocking the opposite magnetic member. Or otherwise, both of the facing sides of the magnetic members are applied as flat surface for adhesively attaching two magnetic members together. It is noted that any fixing or attaching means could be applied for securely attaching two magnetic members with each other. The ultimate goal of the present invention is to provide a magnetic air gap between two detachably attached magnetic members so as to ensure the magnetic field centre of the closed magnetic circuit.

According to the present invention, the coils of the magnetic energy generator is regularly winded onto the There are two engaging shoulders respectively defined at two side ends of the magnetic member for ensuring two magnetic members detachably coupled with each other to form the magnetic body. It is noted such engaging shoulder could ensure two engaging members attached at a stable manner. Finally, the insulated bakelites are correspondingly provided within the magnetic gaps for supporting the electromagnetic coils. The magnetic member could be defined as rectangular body shape, half-circle shape and any other irregular shape.

These and other objectives, features, and advantages of the present invention will become apparent from the following detailed description, the accompanying drawings, and the appended claims.

DETAILED DESCRIPTION OF THE PREFERRED EMBODIMENT

Figure 1:
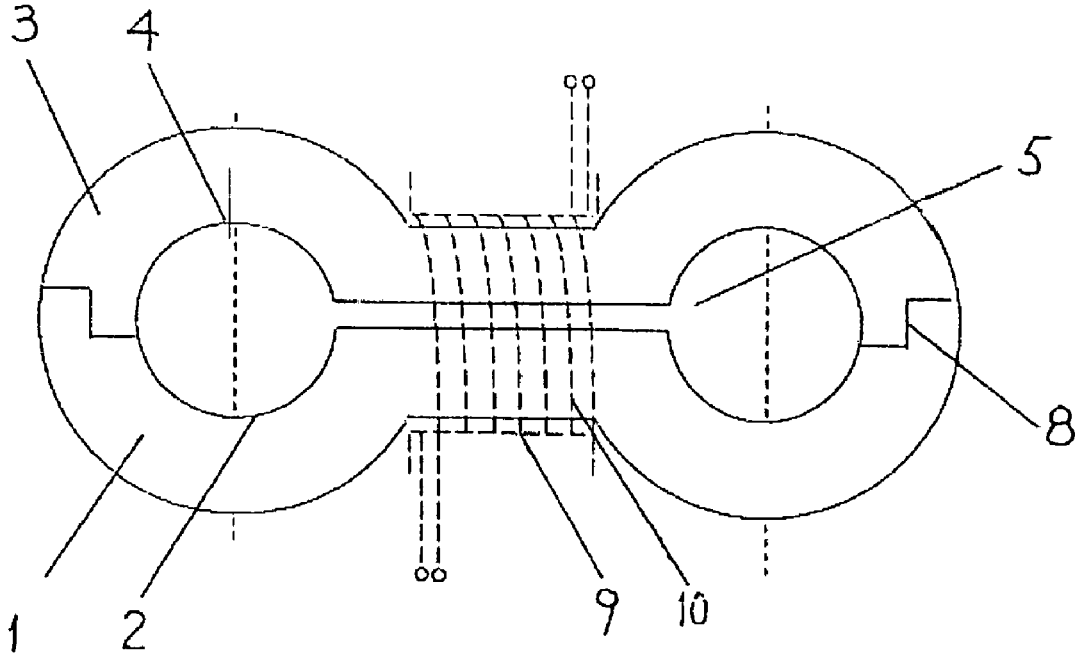
FIG. 1 is a schematic view of a magnetic energy generator according to a preferred embodiment of the present invention.

Referring to FIG. 1, the magnetic energy generator according to the present invention is illustrated, wherein the magnetic energy generator 1 is an assembled magnetic body comprising a pair of detachable magnetic members, namely magnetic member 1 and magnetic member 3, jointed with each other at a face to face manner. The magnetic member 1 has two indented grooves 2 at a facing side, and the magnetic 2 has two indented grooves 4 at a correspondingly facing side as well, wherein two side ends of the respective magnetic member are adapted to be coupled with counterpart side end of the opposite magnetic member so as to joint two separated magnetic members together in such a manner that when two detachable magnetic members approach with each other, two correspondingly mated indented grooves will be aligned and combined, and a magnetic air gap 5 will be formed between two indented grooves. It is noted such magnetic air gap 5 is defined between two detachable magnetic members as well for communicating separated indented grooves. Due to the fact that two detachable magnetic members 1, 3 are coupled side by side, the magnetic body's position could be well secured. According to the present invention, the side ends of one magnetic member are provided with a pair of engaging shoulder 8, while the side ends of the remaining magnetic member are embodied as a pair of engaging terrace for correspondingly matching with the engaging shoulders 8 so as to securely couple two detachable magnetic members with a face to face manner. Furthermore, the magnetic body of the present invention also comprises a bakelite frame disposed a middle portion, in which the magnetic air gap 5 is defined, for winding an electromagnetic coil 10. It is noted the grooves indented magnetic member could be defined as rectangle shape or half-circle shape or any other irregular shapes. Since the magnetic air gap 5 is predetermined formed between two detachably coupled magnetic members, such that a center portion of the magnetic field could be accurately located and a fixed closed magnetic air gap is capable of recording the volume of the electromagnetic induction current.

Figure 2:
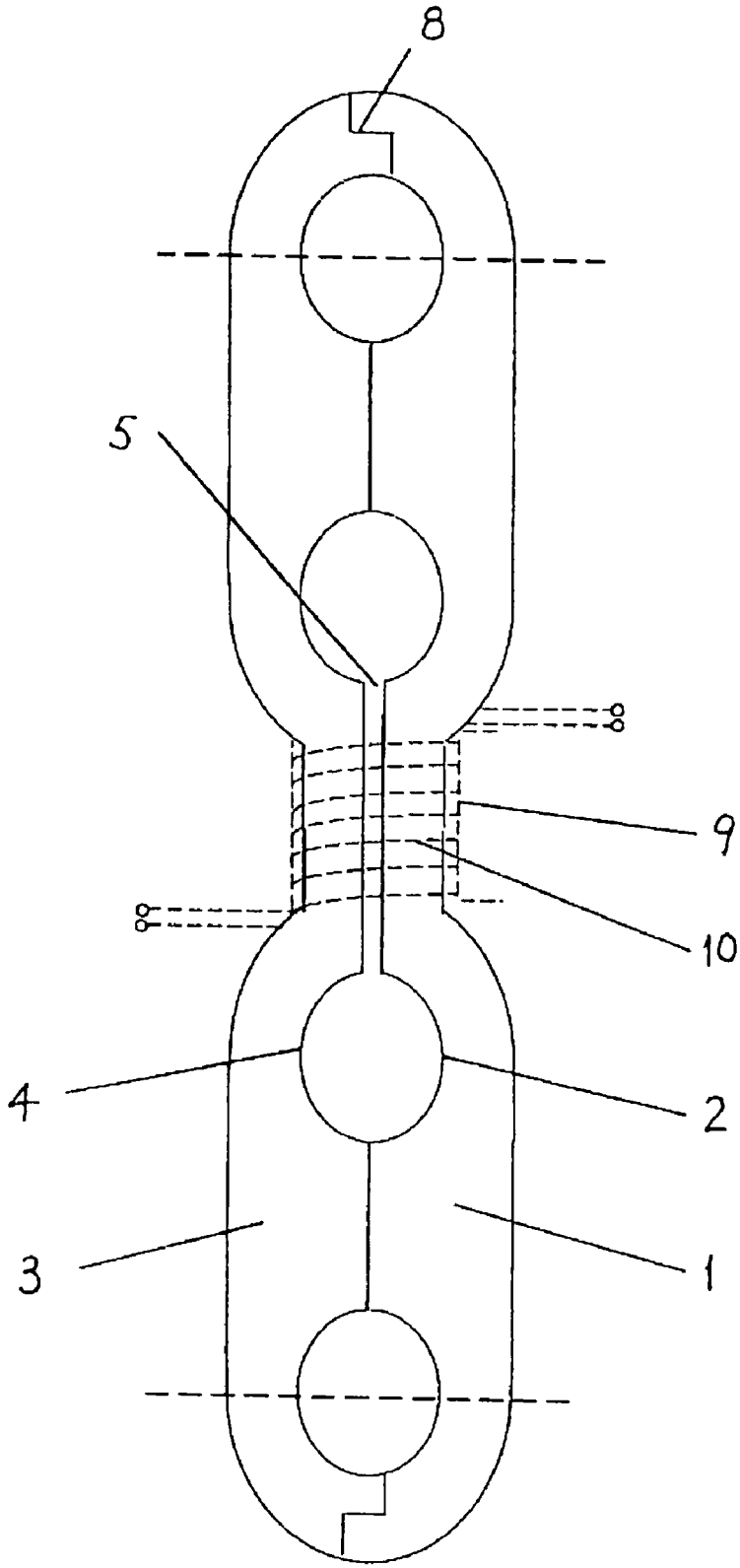
FIG. 2 is a schematic view of a magnetic energy generator according to a second embodiment of the present invention.

Referring to FIG. 2, the magnetic body comprises a pair of detachable magnetic members, namely magnetic member 1 and magnetic member 3, jointed together with a face to face manner. The magnetic member 1 has four indented grooves 2 at a facing side, and the magnetic 2 has four indented grooves 4 at a correspondingly opposite facing side as well, wherein two side ends of the respective magnetic member are adapted to be coupled with counterpart side end of the opposite magnetic member so as to joint two separated magnetic members together in such a manner that when two detachable magnetic members approach with each other, four correspondingly mated indented grooves will be aligned and combined, and a magnetic air gap 5 will be formed between two inner indented grooves. It is noted such magnetic air gap 5 is defined between two detachable magnetic members as well for communicating separated indented grooves. According to the present invention, the side ends of one magnetic member are provided with a pair of engaging shoulders 8, while the side ends of the remaining magnetic member are embodied as a pair of engaging terrace for correspondingly matching with the engaging shoulder 8 so as to securely couple two detachable magnetic members with a face to face manner. Furthermore, the magnetic body of the present invention also comprises a bakelite frame disposed a middle portion, in which the magnetic air gap 5 is defined, for winding an electromagnetic coil 10.

Figure 3:
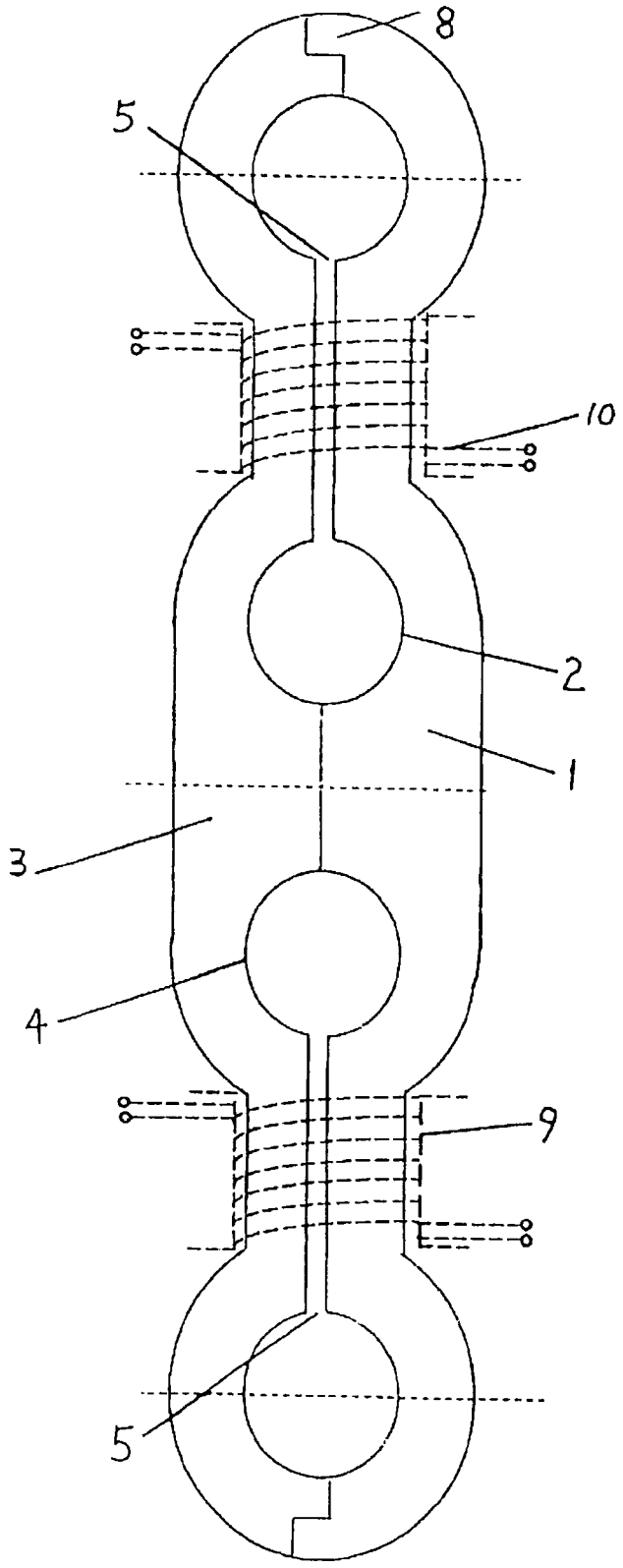
FIG. 3 is a schematic view of a magnetic energy generator according to a third embodiment of the present invention.

FIG. 3 illustrates another embodiment of the present invention. Referring to FIG. 2, the magnetic body comprises a pair of detachable magnetic members, namely magnetic member 1 and magnetic member 3, jointed together with a face to face manner. The magnetic member 1 has four indented grooves 2 at a facing side, and the magnetic 2 has four indented grooves 4 at a correspondingly opposite facing side as well, wherein two side ends of the respective magnetic member are adapted to be coupled with counterpart side end of the opposite magnetic member so as to joint two separated magnetic members together in such a manner that when two detachable magnetic members approach with each other, four correspondingly mated indented grooves will be aligned and combined, and two separate magnetic air gaps 5 will be formed between two outside indented grooves. It is noted such magnetic air gaps 5 are defined between two detachable magnetic members as well for communicating two pair of separated indented grooves. According to the present invention, the side ends of one magnetic member are provided with a pair of engaging shoulders 8, while the side ends of the remaining magnetic member are embodied as a pair of engaging terrace for correspondingly matching with the engaging shoulder 8 so as to securely couple two detachable magnetic members with a face to face manner. Furthermore, the magnetic body of the present invention also comprises a bakelite frame disposed a middle portion, in which the magnetic air gap 5 is defined, for winding an electromagnetic coil 10.

Figure 4:
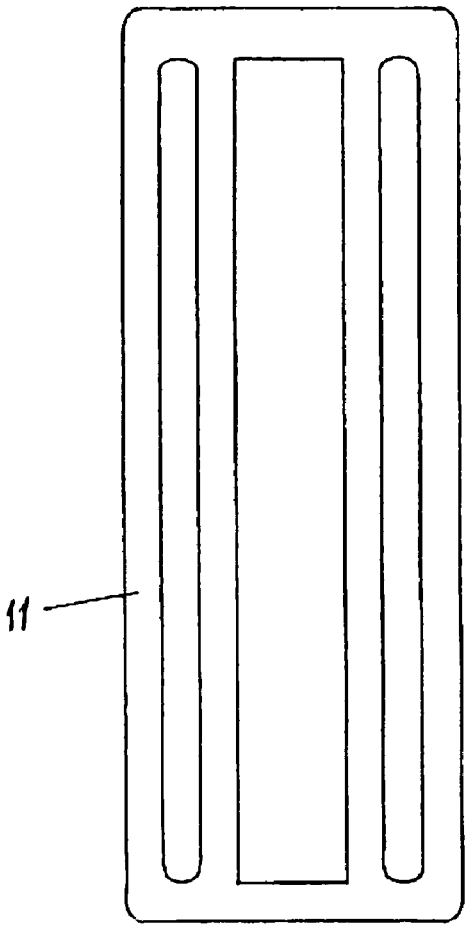
FIG. 4 is a schematic view showing a light body structure according to the present invention.

As shown in FIG. 4, the light body 11 of the magnetic light according to the present invention is illustrated. The light body 11 is an enclosed hollow body having an inner cavity, wherein a fluorescent layer is coated onto the inner cavity; inert gas and mercury are received within the inner cavity. It is noted that inside pressure within the inner cavity is no less than 300 mp.

Figure 5:
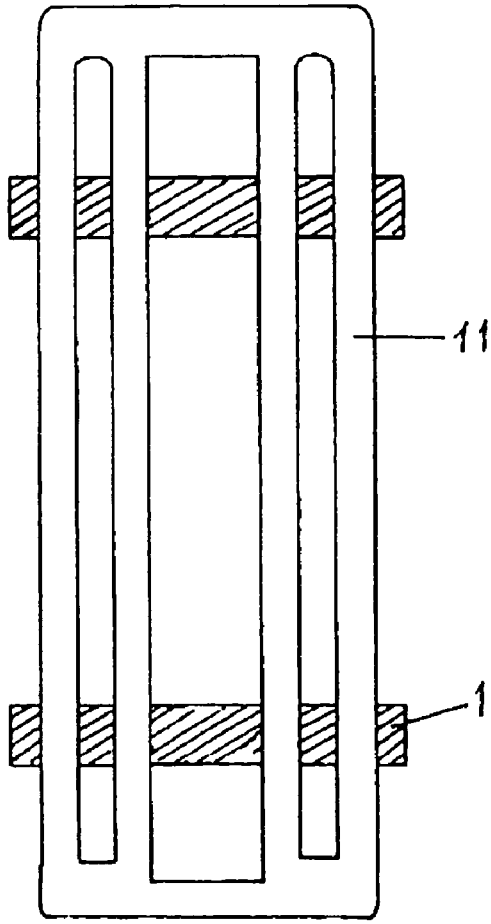
FIG. 5 is a schematic view of a magnetic light according to above preferred embodiment of the present invention.

As shown in FIG. 5, the magnetic light according to the present invention comprises a light body 11, and a magnetic energy generator for supporting the light body 11, wherein the magnetic energy generator comprises a pair of detachable magnetic members 1 having at least two indented grooves for receiving the light body 11 therein so as to wrap the light body 11 therebetween for allowing the light body penetrating through the magnetic energy generator.

Figure 6:
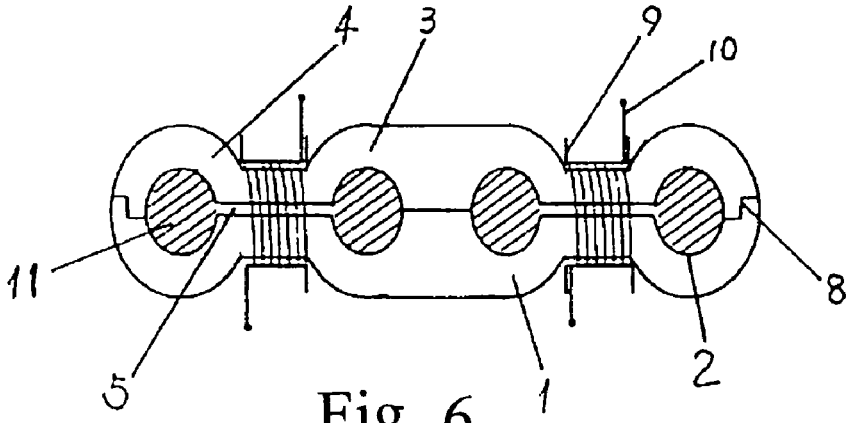
FIG. 6 is a schematic view of a magnetic light according to above second embodiment of the present invention.

As shown in FIG. 6, the magnetic light comprises a light body 11 and a magnetic energy generator for supporting the light body 11, wherein the magnetic energy generator comprises a pair of detachable magnetic members, namely magnetic member 1 and magnetic member 3, jointed together with a face to face manner, namely magnetic member 1 and magnetic member 3, The magnetic member 1 has four indented grooves 2 at a facing side, and the magnetic 2 has four indented grooves 4 at a correspondingly facing side as well, wherein two side ends of the respective magnetic member are adapted to be coupled with counterpart side end of the opposite magnetic member so as to assemble two separated magnetic members together in such a manner that when two detachable magnetic members approach with each other, four correspondingly mated indented grooves will be aligned and combined, and two magnetic air gaps 5 will be formed between every two outside indented grooves of each magnetic member. It is noted such magnetic air gaps 5 are defined between two detachable magnetic members as well for communicating separated indented grooves. According to the present invention, the side ends of one magnetic member are provided with a pair of engaging shoulder 8, while the side ends of the remaining magnetic member are embodied as a pair of engaging terrace for correspondingly matching with the engaging shoulders 8 so as to securely couple two detachable magnetic members with a face to face manner. Furthermore, the magnetic body of the present invention also comprises a bakelite frame disposed a middle portion, in which the magnetic air gap 5 is defined, for winding an electromagnetic coil 10. The light body is disposed within the indented grooves in such a manner that two detachable magnetic members are sandwich and wrap the light body therebetween thus ensuring the light body penetrating through the magnetic energy generator.

Figure 7:
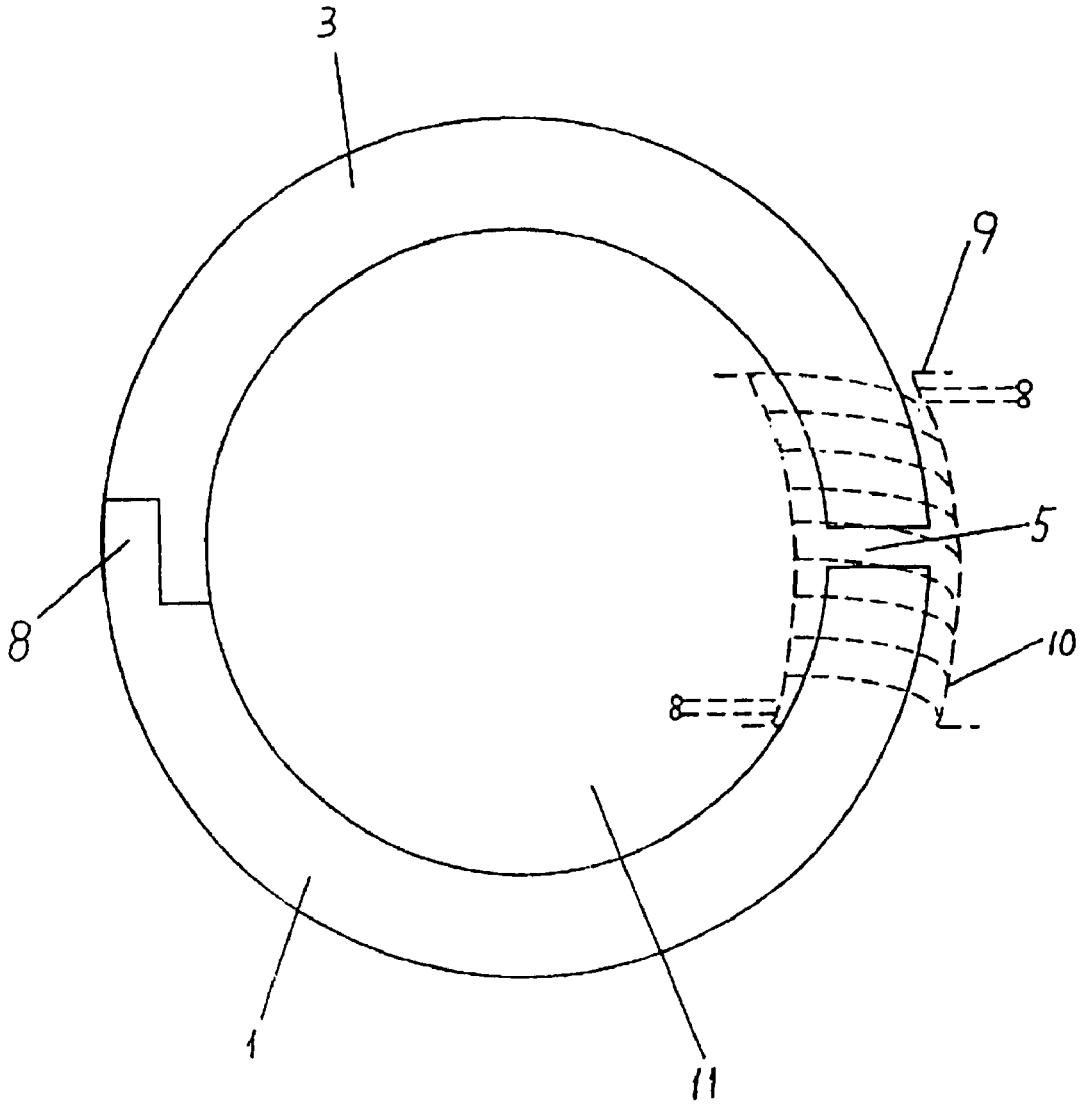
FIG. 7 is a schematic view of a magnetic light according to above third embodiment of the present invention.

As shown in FIG. 7, the magnetic energy generator according to the present invention comprises a pair of detachable magnetic members, each of which is half-pipe shaped to define a groove, whenever two detachable magnetic member approach and joint with a face to face manner, two half-pipe shaped magnetic members will automatically combine to form a round shape magnetic body, wherein a magnetic air gap 5 is form at one side of the magnetic body. The bakelite 9 is provided adjacent to the magnetic air gap for winding up an electromagnetic coil 10. According to the present invention, the one side of one magnetic member are provided with an engaging shoulder 8, while the side end of the remaining magnetic member are embodied as an engaging terrace for correspondingly matching with the engaging shoulder 8 so as to securely couple two detachable magnetic members with a face to face manner. The light body 11 is supposedly disposed within the magnetic body to be wrapped up the pair of detachable half-pipe magnetic members.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A magnetic energy generator, comprising:

a pair of magnetic members each having a predetermined cross sectional shape to define a facing side and a opposite outer side, and at least a first indented groove indently formed at a predetermined position of said facing side of said magnetic member, wherein said magnetic members are arranged to be securely positioned such that said facing sides of said magnetic members are positioned in an edge-to-edge manner so as to allow said first indented groove of each of said magnetic members to substantially align and communicate with each other to form a first magnetic air gap within said first indented grooves of said magnetic members;

an insulated frame provided onto said magnetic members; and an electromagnetic coil comprising at said one enameled magnet wire repeatedly wound on said insulated frames on said magnetic members so as to achieve a stable electromagnetic intensity of a completed magnetic circuit at said magnetic members.

2. The magnetic energy generator, as recited in claim 1, wherein each of said magnetic members further has a second indented groove formed at said facing side of said magnetic member at a position spacedly apart from said first indented groove, wherein each of said second indented grooves of each of said magnetic members is arranged to align with said second indented groove of another of said magnetic member to form a second magnetic air gap, wherein said insulated frames is provided on said magnetic members at a position between said first and said second magnetic air gaps for being wound by said electromagnetic coil.

3. The magnetic energy generator, as recited in claim 2, wherein each of said magnetic members further has third and fourth formed at said facing side of said magnetic member at a position spacedly apart from said first and second indented grooves, wherein each of said third and fourth indented grooves of each of said magnetic members is arranged to align with said third and fourth indented groove of another of said magnetic member to form a third and a fourth magnetic air gaps, wherein said insulated frames is provided on said magnetic members at a position where two of said first through fourth magnetic air gaps are formed at two sides of said insulated frames for being wound by said electromagnetic coil.

4. The magnetic energy generator, as recited in claim 3, wherein each of said magnetic member further has at least one engaging shoulder having a predetermined cross section formed on said magnetic, wherein said engaging shoulders of said magnetic members are aligned and are arranged to detachably engage with each other for ensuring secure engagement of said magnetic members for providing said stable magnetic intensity.

5. The magnetic energy generator, as recited in claim 2, wherein each of said magnetic member further has at least one engaging shoulder having a predetermined cross section formed on said magnetic, wherein said engaging shoulders of said magnetic members are aligned and are arranged to detachably engage with each other for ensuring secure engagement of said magnetic members for providing said stable magnetic intensity.

6. The magnetic energy generator, as recited in claim 1, wherein each of said magnetic member further has at least one engaging shoulder having a predetermined cross section formed on said magnetic, wherein said engaging shoulders of said magnetic members are aligned and are arranged to detachably engage with each other for ensuring secure engagement of said magnetic members for providing said stable magnetic intensity.

7. A magnetic light, comprising:

a magnetic energy generator, which comprises:

a pair of magnetic members each having a predetermined cross sectional shape to define a facing side and a opposite outer side, and at least a first indented groove indently formed at a predetermined position of said facing side of said magnetic member, wherein said magnetic members are arranged to be securely positioned such that said facing sides of said magnetic members are positioned in an edge-to-edge manner so as to allow said first indented groove of each of said magnetic members to substantially align and communicate with each other to form a first magnetic air gap within said first indented grooves of said magnetic members;

an insulated frame provided onto said magnetic members; and an electromagnetic coil comprising at said one enameled magnet wire repeatedly wound on said insulated frames on said magnetic members so as to achieve a stable electromagnetic intensity of a completed magnetic circuit at said magnetic members; and a light body having an inner cavity, and comprising a fluorescent coated onto said inner cavity, a predetermined amount of inert gas and a predetermined amount of mercury received within said inner cavity, wherein said light body is arranged to securely mount in said first magnetic air gap so that when said magnetic energy generator is activated, a stable electromagnetic field is generated for illuminating said light body.

8. The magnetic light, as recited in claim 7, wherein each of said magnetic members further has a second indented groove formed at said facing side of said magnetic member at a position spacedly apart from said first indented groove, wherein each of said second indented grooves of each of said magnetic members is arranged to align with said second indented groove of another of said magnetic member to form a second magnetic air gap, wherein said insulated frames is provided on said magnetic members at a position between said first and said second magnetic air gaps for being wound by said electromagnetic coil, wherein said light body is adapted to be bent for penetrating said first and said second magnetic air gaps.

9. The magnetic light, as recited in claim 8, wherein each of said magnetic members further has third and fourth formed at said facing side of said magnetic member at a position spacedly apart from said first and second indented grooves, wherein each of said third and fourth indented grooves of each of said magnetic members is arranged to align with said third and fourth indented groove of another of said magnetic member to form a third and a fourth magnetic air gaps, wherein said insulated frames is provided on said magnetic members at a position where two of said first through fourth magnetic air gaps are formed at two sides of said insulated frames for being wound by said electromagnetic coil, wherein said light body is adapted to bent to penetrate said first through fourth magnetic air gaps.

10. The magnetic light, as recited in claim 9, wherein each of said magnetic member further has at least one engaging shoulder having a predetermined cross section formed on said magnetic, wherein said engaging shoulders of said magnetic members are aligned and are arranged to detachably engage with each other for ensuring secure engagement of said magnetic members for providing said stable magnetic intensity.

11. The magnetic light, as recited in claim 8, wherein each of said magnetic member further has at least one engaging shoulder having a predetermined cross section formed on said magnetic, wherein said engaging shoulders of said magnetic members are aligned and are arranged to detachably engage with each other for ensuring secure engagement of said magnetic members for providing said stable magnetic intensity.

12. The magnetic light, as recited in claim 7, wherein each of said magnetic member further has at least one engaging shoulder having a predetermined cross section formed on said magnetic, wherein said engaging shoulders of said magnetic members are aligned and are arranged to detachably engage with each other for ensuring secure engagement of said magnetic members for providing said stable magnetic intensity.

* * * * *